United States Patent [19]

Purton

[11] 3,999,882

[45] Dec. 28, 1976

[54] FLUSHING AND COOLING SYSTEM FOR SHAFT SEALS AND PUMPS

[75] Inventor: Robert M. Purton, Cerritos, Calif.

[73] Assignee: Dresser Industries, Inc., Dallas, Tex.

[22] Filed: Mar. 17, 1975

[21] Appl. No.: 559,187

[52] U.S. Cl. ..... 415/112

[51] Int. Cl.[2] ..... F01D 11/10

[58] Field of Search ..... 415/110, 111, 112; 277/3, 74, 134

[56] References Cited

UNITED STATES PATENTS

| | | | |
|---|---|---|---|
| 1,733,416 | 10/1929 | Lebesnerois | 277/134 |
| 1,737,870 | 12/1929 | Telfer | 415/112 |
| 2,738,996 | 3/1956 | Anderson | 415/112 |
| 3,128,713 | 4/1969 | Nechinc | 415/112 |
| 3,257,957 | 6/1966 | Tracy | 415/112 |
| 3,746,350 | 7/1973 | Mayer et al. | 277/134 |

*Primary Examiner*—Carlton R. Croyle
*Assistant Examiner*—L. J. Casaregola
*Attorney, Agent, or Firm*—R. L. Van Winkle; J. N. Hazelwood

[57] ABSTRACT

The improved flushing and cooling system of this invention includes a pumping ring seal located at each end of the pump with the seal located adjacent to the discharge being in fluid communication with a pressure-reducing device in the pump. The pressure-reducing device is also connected by means of a bypass conduit with the seal located adjacent the pump inlet and with the pump inlet itself. A flow control orifice member is located adjacent the pressure-reducing device and is arranged to control flow from the by-pass conduit into and out of the pumping ring seal that is located adjacent the pump discharge. A second flow control orifice member is located adjacent the pump inlet and functions to control the flow into and out of the seal located adjacent the pump inlet. The arrangement of the system is such that the fluid passing through the pump is utilized to cool and flush both of the seals and to maintain the seals at substantially the same pressure.

3 Claims, 2 Drawing Figures

FLUSHING AND COOLING SYSTEM FOR SHAFT SEALS AND PUMPS

BACKGROUND OF THE INVENTION

In the past, pumps, and particularly multi-stage pumps, have been provided with some form of fluid by-pass or equalizing conduit extending from the seals on the inlet end of the pump to the seals on the discharge end of the pump so that the pressure on the seals will be substantially equal. Also, it has been necessary in the past to, in most instances, provide some form of cooling and flushing for the seals. This has ordinarily been accomplished by providing a completely external circuit through which fluid was delivered to the seals through a filter and some form of heat exchanger wherein the heat generated in the seals could be extracted.

The object of this invention is to provide an improved seal flushing and cooling system wherein the fluid being pumped is reduced in pressure and filtered within the pump so that it can be utilized as a flushing and cooling medium without further treatment. Furthermore, with the system described herein the use of the heat exchangers can be eliminated.

SUMMARY OF THE INVENTION

This invention provides an improved flushing and cooling system for shaft seals and pumps that include a housing having an inlet, a discharge and an impeller shaft journaled in the housing. The improved system comprises means for reducing the pressure in the pump that is in communication with the pump discharge, a by-pass conduit having a first end in fluid communication with the pressure-reducing means and a second end in fluid communication with the pump inlet, and first and second shaft seal means located in the housing adjacent the pump inlet and pump discharge, respectively, for forming the seal between the shaft and housing. Each shaft seal means includes means rotatable with the shaft for pumping fluid and each includes a fluid inlet and outlet. A first fluid flow control means is located between the by-pass conduit and the pump inlet and has a passageway therethrough that provides fluid communication between the conduit and the pump inlet. The passageway is connected with the inlet and outlet of the first shaft seal means for diverting a portion of the fluid in the by-pass conduit through the first shaft means to flush and cool the first shaft seal means. The system also includes a second flow control means that is located between the by-pass conduit and the pressure-reducing means. The second flow control means has a passageway therethrough providing fluid communication between the conduit and the pressure-reducing means. The passageway is connected with the inlet and outlet of the second shaft seal means for diverting a portion of the fluid in the by-pass conduit through the second shaft seal means to flush and cool the second shaft seal means.

The foregoing and additional objects and advantages will become more apparent as the following detailed description is read in conjunction with the accompanying drawing.

DESCRIPTION OF THE PREFERRED EMBODIMENT

Figure 1:
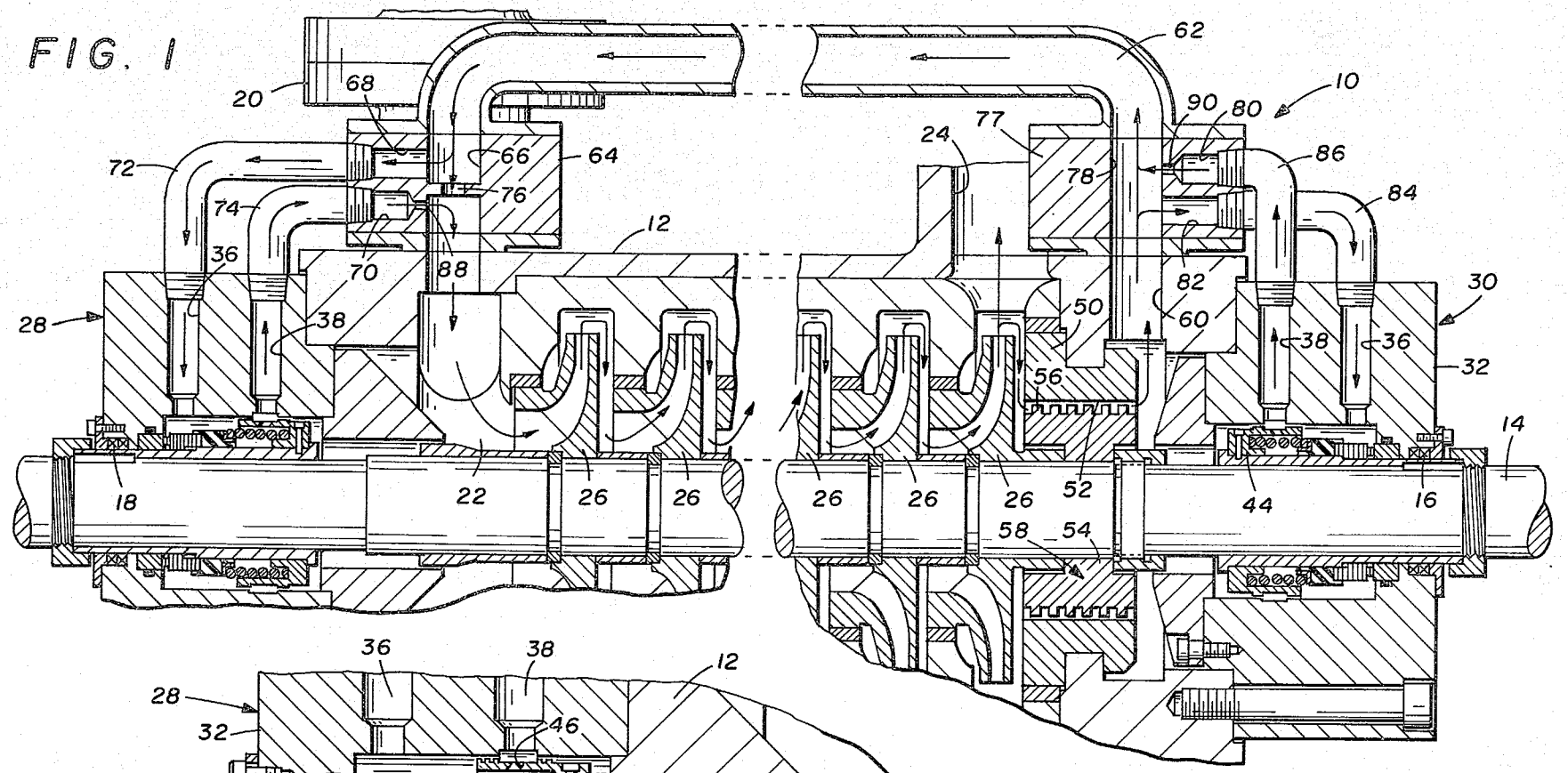
FIG. 1 is a cross-sectional view illustrating a centrifugal pump having the improved flushing and cooling system constructed in accordance with the invention incorporated therein.

Referring to the drawing and to FIG. 1 in particular, shown therein and generally designated by the reference character 10 is a multi-stage centrifugal pump that includes a housing 12 rotatably supporting an impeller shaft 14 through bearings 16 and 18. The pump housing 12 includes an inlet connection 20 and inlet passageway 22. The housing 12 is also provided with an outlet or discharge 24. The impeller shaft 14 supports a plurality of centrifugal impellers 26 that are mounted on the shaft 14 and rotate therewith to move fluid from the pump inlet 22 through the pump discharge 24.

Figure 2:
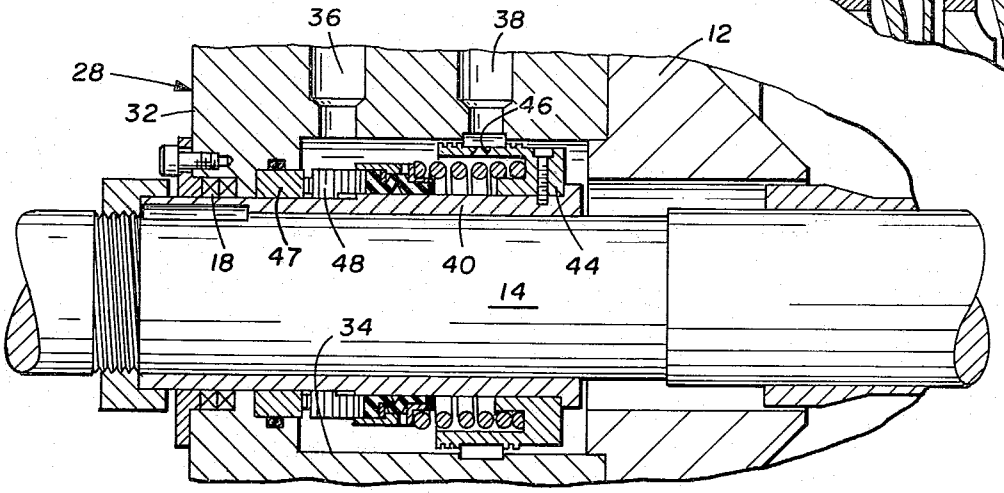
FIG. 2 is an enlarged fragmentary view of a portion of the apparatus of FIG. 1.

Attached to the inlet end of the pump 10 is a seal assembly 28. Mounted on the discharge end of the pump 10 is seal assembly 30. As can be appreciated from viewing FIG. 1, the seal assemblies 28 and 30 are substantially identical in configuration although in their assembly on the pump housing 12. Due to the substantial identity in construction, only the seal assembly 28 will be described in detail in connection with FIG. 2.

As illustrated more clearly in that figure, the seal assembly 28 includes a housing 32 that is connected to the pump housing 12. The housing 32 has a bore 34 that encircles the impeller shaft 14. An inlet port 36 and an outlet port 38 extend through the housing 32 into the bore 34 for purposes that will be described more fully hereinafter.

A sleeve 40 is attached to the impeller shaft 14 for rotation therewith. It will be noted that the sleeve 40 is disposed within the bearing 18 which journals the impeller shaft 14 in the pump housing 12. Attached to the sleeve 40 is a pump ring 44 that extends across the outlet port 38 in the seal housing 32. A plurality of circumferentially spaced pump ports 46 are located in the pump ring 44 and are arranged to pump fluid from the bore 34 outwardly through the outlet port 38 in the housing 32. To prevent fluid from leaking from the bore 34, the seal assembly 28 is provided with a wear ring 47 that is slidingly and sealingly engaged by a seal ring 48 that rotates with the sleeve 40. The ring 48 also sealingly engages the sleeve 40.

Returning to FIG. 1, it can be seen that a bushing 50 is located in the pump housing 12 adjacent the discharge 24. The bushing 50 has a bore 52 extending therethrough and sized to closely receive a collar 54 that is mounted on and rotates with the impeller shaft 14. The collar 54 has a thread 56 formed on its outer periphery. The helix of the thread 56 is preferably in a direction so that rotation of the shaft 14 tends to cause the thread 56 to oppose the movement of fluid from the discharge 24 outwardly, that is, to the right as illustrated in FIG. 1.

The thread 56 and the bore 52 in the bushing 50 cooperate to form a relatively narrow passageway that functions to filter any fluid flowing therebetween and also to reduce the pressure of any fluid flowing from the discharge 24 outwardly between the bushing 50 and collar 54. If desired, a plurality of annular lands and grooves may be formed on either or both of the bushing 50 and collar 54 in lieu of the thread 56. The combined structure of the bushing 50 and the collar 54 will be referred to hereinafter as the pressure-reducing device 58.

As previously mentioned, the left end as viewed in FIG. 1 of the pressure-reducing device 58 is exposed to the pressure of the fluid in the discharge 24, but is not directly in the path of discharged fluid. The right end, as viewed in FIG. 1, is open into a by-pass passageway 60 formed in the housing 12. Connected in fluid communication with the passageway 60 is a by-pass conduit 62 that extends from the pressure-reducing device 58 to the inlet passageway 22 of the pump 10.

Disposed in the conduit 62 adjacent the inlet passageway 22 is a flow control member 64. The flow control member 64 has a passageway 66 extending therethrough that is intersected by lateral ports 68 and 70. The lateral port 68 is connected to the inlet port 36 of the seal assembly 28 by a conduit 72 and the lateral port 70 is connected to the discharge port 38 of the seal assembly 28 by a conduit 74. Disposed in the passageway 66 between the lateral ports 68 and 70 is an orifice member 76 that serves to aid in the control of fluid flow into the conduit 72 and out of the conduit 74.

Located in the by-pass conduit 62 adjacent the pressure-reducing device 58 is a flow control member 77. The flow control member 77 has a passageway 78 extending therethrough that is intersected by lateral ports 80 and 82. The lateral port 82 is connected by a conduit 84 with the inlet port 36 of the seal assembly 30. Similarly, the lateral port 80 is connected by a conduit 86 with the outlet port 38 of the seal assembly 30. It will also be noted that the lateral ports 70 and 80 which are connected with discharge ports 38 of the seal assemblies 28 and 30 are provided with an orifice 88 and an orifice 90, respectively. As can be appreciated, the orifice 88 and the orifice 90 also serve to aid in control in the flow of fluid from the seal assemblies 28 and 30 into the by-pass conduit 62.

OPERATION OF THE PREFERRED EMBODIMENT

With the pump 10 in operation, that is with the impeller shaft 14 rotating, fluid flows in through the inlet 20 and inlet passageway 22 into the plurality of impellers 26 which move the fluid through the housing 12 until it reaches the pump discharge 24. The left end of the pressure-reducing device 54 is exposed to the pressure of fluid in the discharge 24.

Rotation of the impeller shaft 14 rotates the collar 54 within the bore 52 within the bushing 50. As previously mentioned, the collar 54 fits relatively closely within the bushing 50 and the thread 56 on the collar 54 is arranged to influence the fluid to move toward the pump discharge 24. Thus, the close restriction and the thread direction tend to cause a pressure drop in fluid flowing from the pump discharge 24 into the passageway 60 across the pressure-reducing device 54. Also, due to the close tolerance, the fluid is filtered within the pressure-reducing device so that relatively clean fluid enters the passageway 60.

As the fluid flows through the passageway 60 into the by-pass conduit 62 toward inlet passageway 22, a restriction is created by the orifice 76 in the flow control member 64 diverting a portion of the fluid from the flow control member 76 into the inlet port 36 of the seal assembly 30. Fluid passing through the bore 34 of the seal assembly 30 is discharged by the pump ring 44 into the outlet port 38 therein. The fluid is at an increased pressure and is returned into the by-pass conduit 62 through the orifice 90 which is also located in the flow control member 76. Thus, a constant circulation of relatively clean, filtered fluid is supplied to the seal assembly 30 for the purpose of cooling and flushing the seals contained therein.

The orifice 76 located in the flow control member 64 also aids in diverting a portion of the fluid in the by-pass conduit 62 into the inlet port 36 of the seal assembly 28. Fluid entering through the inlet port 36 flows through the bore 34 and outwardly through the outlet port 38 of the seal assembly 28 by virtue of the pumping characteristic of the seal ring 44 contained therein. Fluid from the outlet port 38 of the seal assembly 28 is returned into the passageway 66 of the flow control member 64 downstream of the orifice 76 through an orifice 88. Thus, it can be seen that a constant supply of clean, filtered fluid is also maintained in the seal assembly 28 assuring that the seal assembly 28 will be cooled and flushed. It should also be pointed out that the seal assemblies 28 and 30 are maintained at substantially the same pressure and temperature due to the interconnection of such seal assemblies by the by-pass conduit 62.

From the foregoing, it can be appreciated that the improved flushing and cooling system for shaft seals described in detail hereinbefore is fully integrated within the pump 10 eliminating the need for external filters, fluid supply, or heat exchangers for the purpose of flushing and cooling the seals contained within the pump.

Having described but a single embodiment of the invention, it will be appreciated that many changes and modifications can be made thereto without departing from the spirit and scope of the invention.

The embodiments of an invention in which an exclusive property or privilege is claimed are defined as follows:

1. An improved flushing and cooling system for shaft seals in pumps that include a housing having an inlet, a discharge and an impeller shaft journaled in the housing, said system comprising:

pressure-reducing means in the pump in communication with the pump discharge for removing a portion of the fluid from the pump discharge at a reduced pressure;

a by-pass conduit having a first end in fluid communication with said pressure-reducing means and a second end in fluid communication with the pump inlet;

first and second shaft seal means located in the housing adjacent the pump inlet and pump discharge, respectively, for forming a seal between the shaft and housing, said shaft seal means each including means rotatable with the shaft for pumping fluid and each including a fluid inlet and outlet;

first flow control means located between said by-pass conduit and the pump inlet, said first flow control means having a passageway therethrough providing fluid communication between said conduit and pump inlet, said passageway being connected with the inlet and outlet of said first shaft seal means and having a flow control orifice located in said passageway between said connections of the inlet and outlet of said first shaft seal means for diverting a portion of the fluid in said by-pass conduit through said first shaft seal means to flush and cool said first shaft seal means;

second flow control means located between said by-pass conduit and said pressure-reducing means, said second flow control means having a passageway therethrough providing fluid communication between said conduit and pressure-reducing means, said passageway being connected with the inlet and outlet of said second shaft seal means for diverting a portion of the fluid in said by-pass conduit through said second shaft seal means to cool and flush said second shaft seal means;

each of said flow control means also including a flow restricting orifice located to restrict flow into said by-pass conduit from the outlet of a respective one of said shaft seal means.

2. The improved system of claim 1 wherein said pressure-reducing means includes:

a first member mounted in the pump housing having an inlet end disposed in the pump discharge and an outlet end disposed in fluid communication with said by-pass conduit and encircling said shaft and having a bore extending therethrough; and, a second member connected to and encircling said shaft and disposed within said bore, said second member having an inlet end disposed in the pump discharge and an outlet end disposed in fluid communication with said by-pass conduit and having an outer periphery fitting closely within said first member to form passageway means therebetween for restricting the flow between said inlet and outlet ends causing a differential in pressure thereacross.

3. The improved system of claim 2 wherein the outer periphery of said second member is provided with a helical groove arranged, when rotated, to influence fluid movement in opposition to said differential in pressure across said pressure-reducing means.

* * * * *